United States Patent [19]

Ito

[11] Patent Number: 4,924,678

[45] Date of Patent: May 15, 1990

[54] ELECTRIC CONTROL APPARATUS FOR ICE MAKING MACHINE

[75] Inventor: Yoshinori Ito, Shimane, Japan

[73] Assignee: Hoshizaki Denki Kabushiki Kaisha, Toyoake, Japan

[21] Appl. No.: 375,440

[22] Filed: Jul. 5, 1989

[30] Foreign Application Priority Data

Jul. 5, 1988 [JP] Japan ..... 63-167120

[51] Int. Cl.[5] ..... F25B 41/00; F25C 1/00

[52] U.S. Cl. ..... 62/138; 62/209

[58] Field of Search ..... 62/135, 138, 233, 353, 62/209

[56] References Cited

U.S. PATENT DOCUMENTS

| | | | |
|---|---|---|---|
| 3,964,270 | 6/1976 | Dwyer | 62/138 |
| 3,977,851 | 8/1976 | Toya | 62/135 |
| 4,424,683 | 1/1984 | Manson | 62/135 |

FOREIGN PATENT DOCUMENTS 61-180868 8/1986 Japan .

*Primary Examiner*—William E. Wayner

*Attorney, Agent, or Firm*—Armstrong, Nikaido, Marmelstein, Kubovcik & Murray

[57] ABSTRACT

In an ice making machine having an evaporator unit formed therein with a multiplicity of individual freezing cells and provided thereon with an evaporator in thermal exchange relationship with the freezing cells to freeze water circulated into the freezing cells during a freezing cycle, an electric control apparatus for the ice making machine is arranged to ascertain a frequency of an electric power supplied to the machine, to detect an actual freezing temperature of the evaporator unit, to determine an optimum freezing temperature necessary for complete freezing of all the water in the freezing cells in operation under the power supply of the ascertained frequency, to maintain the freezing cycle until the actual freezing temperature becomes lower than or equal to the optimum freezing temperature and to terminate the freezing cycle and initiate a harvest cycle for discharge of formed ice cubes from the freezing cells when the actual freezing temperature has become lower than or equal to the optimum freezing temperature.

2 Claims, 4 Drawing Sheets

ELECTRIC CONTROL APPARATUS FOR ICE MAKING MACHINE

BACKGROUND OF THE INVENTION

1. Field of the Invention

The present invention relates to an ice making machine wherein a number of ice cubes are simultaneously formed in a multiplicity of individual open-bottom freezing cells and thereupon automatically released from the freezing cells for discharge into an ice storage bin, and more particularly to an electric control apparatus for the ice making machine to insure complete freezing of all the water in the freezing cells in operation under the power supply of different frequency.

2. Description of the Prior Art

In such ice making machines as described above, the water circulated into the freezing cells from a water reservoir is formed into ice cubes during the freezing cycle, and the formed ice cubes are discharged into an ice storage bin during the harvesting cycle. It is, therefore, essential to accurately initiate and terminate the freezing cycle to insure the formation of the desired ice cubes. To this end, various control devices have been proposed for the ice making machines.

For example, Japanese Patent Early Publication No. 61-180868 discloses a control device which is arranged to control the freezing cycle in accordance with changes of an ambient temperature of the machine for producing the desired ice cubes of uniform thickness. However, the compressor of the ice making machine is driven by an alternating voltage applied thereto from a commercially available power source. For this reason, the rotation speed of the compressor under the power supply of 60 Hz will differ from that of the compressor under the power supply of 50 Hz. This causes a difference in ice making capacity of the machine. In the case that the freezing cycle in operation under the power supply of 60 Hz is maintained for a predetermined period sufficient to insure complete freezing of all the water in the freezing cells, a part of the water in the freezing cells may not be frozen into ice cubes for the predetermined period in operation under the power supply of 50 Hz. In the case that the freezing cycle in operation under the power supply of 50 Hz is maintained for a predetermined period sufficient to insure complete freezing of all the water in the freezing cells, the water in the freezing cells is excessively frozen in operation under the power supply of 60 Hz.

SUMMARY OF THE INVENTION

It is, therefore, a primary object of the present invention to provide an electric control apparatus for the ice making machine which is arranged to control the freezing cycle of the machine in accordance with changes of the power source frequency thereby to insure complete freezing of all the water in the freezing cells without causing any problem described above.

A secondary object of the present invention is to provide an electric control apparatus, having the above-described characteristic, capable of controlling the freezing cycle of the ice making machine in accordance with changes of an ambient temperature for providing the desired ice cubes of uniform thickness.

According to the present invention, the primary object is attained by providing an ice making machine having an evaporator unit formed therein with a multiplicity of individual freezing cells and provided thereon with an evaporator in thermal exchange relationship with the freezing cells to freeze water circulated into the freezing cells during a freezing cycle, and means for supplying the water into the freezing cells, wherein an electric control apparatus for the ice making machine comprises first means for ascertaining a frequency of an electric power supplied to the ice making machine, second means for detecting an actual freezing temperature of the evaporator unit, third means for determining an optimum freezing temperature necessary for complete freezing of all the water in the freezing cells in operation under the power supply of the ascertained frequency, and fourth means responsive to an electric signal indicative of the actual freezing temperature from the second means for maintaining the freezing cycle until the actual freezing temperature becomes lower than or equal to the optimum freezing temperature and for terminating the freezing cycle and initiating a harvest cycle for discharge of formed ice cubes from the freezing cells when the actual freezing temperature has become lower than or equal to the optimum freezing temperature.

To attain the secondary object, it is desirable that the electric control apparatus further comprises means for detecting an ambient temperature of the ice making machine, wherein the third means is responsive to an electric signal indicative of the ambient temperature from the detecting means to correct the optimum freezing temperature in consideration with changes of the ambient temperature.

BRIEF DESCRIPTION OF THE DRAWINGS

Additional objects, features and advantages of the present invention will be more readily appreciated from the following detailed description of a preferred embodiment thereof when taken together with the accompanying drawings, in which.

DESCRIPTION OF THE PREFERRED EMBODIMENT

Figure 1:
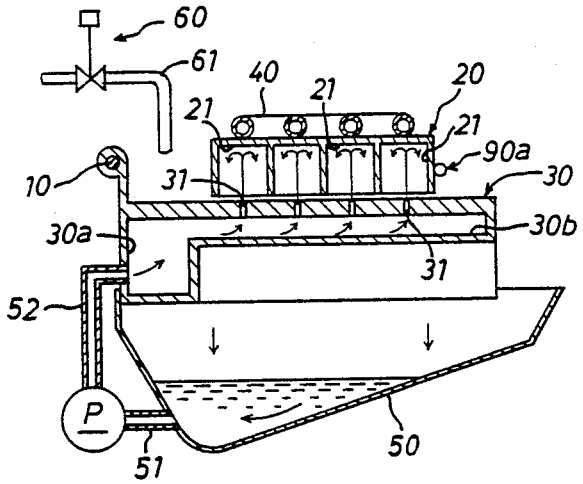
FIG. 1 is a vertical sectional view of a freezing mechanism in an ice making machine during the freezing cycle.
Figure 2:
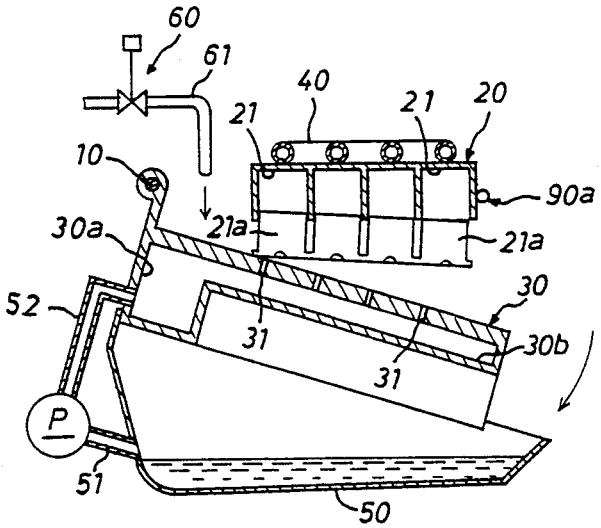
FIG. 2 is a vertical sectional view of the freezing mechanism shown in FIG. 1 during the harvest cycle.

In FIGS. 1 and 2 of the drawings, there is schematically illustrated a freezing mechanism in an ice making machine which is operated under control of an electric control apparatus in accordance with the present invention. The freezing mechanism includes a flat water plate 30 which is pivotally supported by a support shaft 10 in such a manner that the water plate 30 may be raised to a cell closing position during the freezing cycle of operation and lowered during the harvest cycle of operation to permit discharge of formed ice cubes from an ice forming evaporator unit 20. The support shaft 10 is fixedly mounted on a stationary structure in a refrigeration section of the ice making machine, and the evaporator unit 20 is horizontally supported in place within the refrigeration section. The evaporator unit 20 is provided thereon with a refrigerant evaporator coil 40 and is formed therein with a multiplicity of individual open-bottom freezing cells 21 in thermal exchange relationship with the evaporator coil 40.

During the freezing cycle of operation, the water plate 30 is horizontally retained in place by means of a support mechanism (not shown) to close the freezing cells 21 of evaporator unit 20 and to supply the water to be frozen into ice cubes into the freezing cells 21 therethrough from a water reservoir 50. A water pump P is connected at its inlet port to the water reservoir 50 through a pipe 51 and at its outlet port to a pressure chamber 30*a* through a pipe 52 to pick up the water from reservoir 50 and discharge it into the pressure chamber 30*a*. The pressure chamber 30*a* is located under the water plate 30 and is integrally formed with a plurality of distribution chambers 30*b*. A multiplicity of holes 31 formed in the water plate 30 are centrally located in the bottom openings of freezing cells 21 when the water plate 30 is retained in the cell closing position during the freezing cycle. During operation of the pump P, the water is supplied into the distribution chambers 30*b* through the pressure chamber 30*a* and spurts up into the freezing cells 21 through the holes 31 of water plate 30 to be formed into ice on the walls of cells 21. The water which is not immediately frozen will fall through return holes (not shown) in the water plate 30 back into the reservoir 50 to be recirculated again. Thus, the water in reservoir 50 will be recirculated until frozen into ice cubes in the freezing cells 21.

After the freezing cycle has been terminated, as shown in FIG. 2, the water plate 30 is lowered under control of a water plate moving motor Ma (shown in the circuit diagram of FIG. 5) to open the freezing cells 21 of evaporator unit 20, an electrically operated hot gas defrost valve Vh (shown in the circuit diagram of FIG. 6) is opened to release the formed ice cubes from the freezing cells 21, and an electrically operated water supply valve 60 is opened to pour fresh water onto the water plate 30 through a water supply pipe 61. Thus, the ice cubes are discharged from the freezing cells 21 and slid down the water plate 30 to be harvested. In addition, the water supply pipe 61 is connected to a source of water to provide the fresh water necessary for the production of the ice cubes. Prior to the initiation of the following freezing cycle, the fresh water supplied from water supply pipe 61 is allowed to flow into the reservoir 50 when the water plate 30 is in the lower position. The quantity of fresh water introduced into the reservoir 50 is controlled to be substantially equal to the amount of water required to produce the ice cubes in the freezing cells 21.

Figure 3:
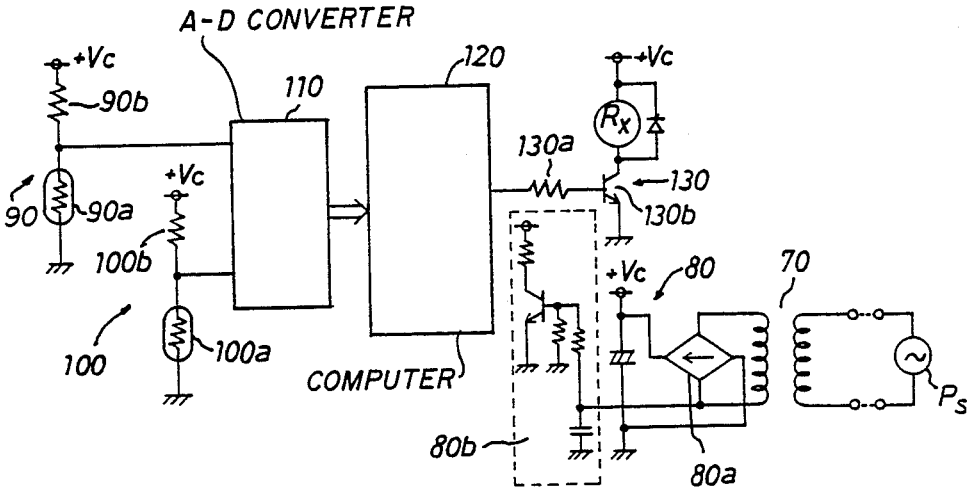
FIG. 3 is an electric control apparatus for the ice making machine.
Figure 4:
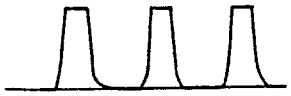
FIG. 4 is a time chart showing an input voltage applied to a wave shaper shown in FIG. 3.
Figure 5:
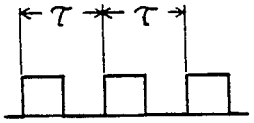
FIG. 5 is a time chart showing a rectangular pulse reshaped by the wave shaper.
Figure 6:
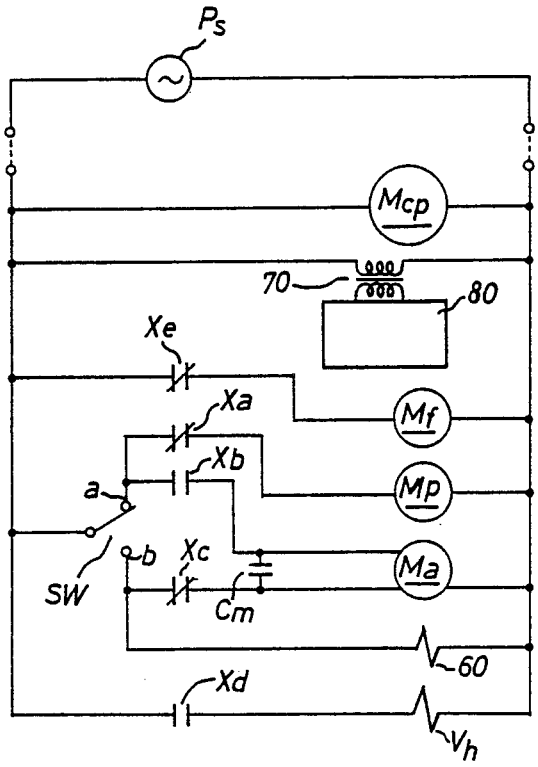
FIG. 6 is a diagram of a relay circuit for control of a refrigeration system of the ice making machine.

Hereinafter, the electric control apparatus for the ice making machine will be described in detail with reference to FIGS. 3 to 6. As shown in FIG. 3, the electric control apparatus includes a transformer 70 arranged to transform an alternating voltage Vs from a commercially available power source Ps into a transformed voltage Vt. The transformer 70 is connected to a wave shaping circuit 80 which is composed of a bridge rectifier 80*a* for rectifying the transformed voltage Vt as shown in FIG. 4 and a wave shaper 80*b* for reshaping the rectified voltage into a rectangular pulse with a period $\tau$ as shown in FIG. 5. The control apparatus further includes a first temperature detecting circuit 90 composed of a first temperature sensor 90*a* connected in series with a resistor 90*b*. As shown in FIGS. 1 and 2, the first temperature sensor 90*a* is attained to an outer periphery of the evaporator unit 20 to detect a temperature of the freezing cells 21 and to cooperate with the resistor 90*b* for producing an electric signal indicative of the freezing temperature of cells 21. The control apparatus further includes a second temperature detecting circuit 100 composed of a second temperature sensor 100*a* connected in series with a register 100*b*. The second temperature sensor 100*a* is located to detect an ambient temperature of the ice making machine and to cooperate with the resistor 100*b* for producing an electric signal indicative of the ambient temperature of the ice making machine. An analog-to-digital or A-D converter 110 is connected to the first and second temperature detecting circuits 90 and 100 to convert the electric signals into digital signals respectively indicative of the freezing temperature and the ambient temperature. A microcomputer 120 is connected to the A-D converter 110 and is programmed to execute a control program illustrated by a flow chart in FIG. 7. During execution of the control program, the computer 120 calculates data required to activate a driving circuit 130 for control of a rely circuit shown in FIG. 6.

The driving circuit 130 includes a transistor 130*b* connected at its base to an output terminal of computer 120 through a resistor 130*a*. The transistor 130*b* is connected at its collector to a relay coil Rx and grounded at its emitter. The relay coil Rx is arranged to cooperate with relay switches Xa, Xc, Xe of the normally closed type and relay switches Xb, Xd of the normally open type shown in FIG. 6 thereby to provide a control relay for the refrigeration system of the ice making machine. When the transistor 130*b* is turned on under control of the computer 120, the relay coil Rx is energized to open the relay switches Xa, Xc, Xe and to close the relay switches Xb, Xd.

An electric motor Mp of the water pump P is connected to the commercially available power source Ps through the relay switch Xa and a changeover switch SW. In this embodiment, the changeover switch SW is arranged in such a manner that a movable contact of switch SW is connected to a first fixed contact *a* when the water plate 30 is retained in the cell closing position during the freezing cycle and that the movable contact of switch SW is connected to a second fixed contact *b* when the water plate 30 is lowered for discharge of the formed ice cubes from the freezing cells 21. When the movable contact of switch SW is connected to the first fixed contact *a* in a condition where the relay switch Xa is maintained in a closed position, the electric motor Mp is activated by the alternating voltage Vs applied thereto from the power source Ps to drive the water pump P during the freezing cycle. The electric motor Ma for moving the water plate 30 is connected to the power source Ps through the relay switch Xb and changeover switch SW and through the relay switch Xc and changeover switch SW. When the relay switch Xb is closed by energization of the relay coil Rx in a condition where the movable contact of switch SW is maintained in contact with the first fixed contact a, the electric motor Ma is activated by the alternating voltage Vs applied thereto from the power source Ps to rotate in one direction thereby to lower the water plate 30 for discharge of the formed ice cubes from the freezing cells 21. When the relay switch Xc is closed by deenergization of the relay coil Rx in a condition where the movable contact of switch SW is maintained in contact with the second fixed contact b, the electric motor Ma is activated by the alternating voltage Vs applied thereto from the power source Ps to rotate in another direction thereby to raise the water plate 30 toward the cell closing position. In the circuit diagram of FIG. 6, a condenser Cm is provided to act the electric motor Ma as a condenser motor.

The electrically operated water supply valve 60 is connected to the power source Ps through the changeover switch SW. When the movable contact of switch SW is connected to the second fixed contact b, the water supply valve 60 is opened by the alternating voltage applied thereto from the power source Ps. The electrically operated hot gas defrost valve Vh is disposed within a bypass conduit between an outlet port of a compressor in the refrigeration system and an inlet port of evaporator coil 40 and is electrically connected to the power source Ps through the relay switch Xd of the normally open type. When the relay switch Xd is closed in response to energization of the relay coil Rx, the defrost valve Vh is opened by the alternating voltage Vs applied thereto from the power source Ps to permit the gaseous refrigerant supplied into the evaporator coil 40 therethrough from the compressor. An electric motor Mf is provided to drive a cooling fan (not shown) for a condensing coil connected to the compressor. The electric motor Mf is connected to the power source Ps through the relay switch Xe. When the relay switch Xe is maintained in a closed position, the electric motor Mf is activated by the alternating voltage Vs applied thereto from the power source Ps to drive the cooling fan. An electric motor Mcp is connected to the power source Ps to drive the compressor when applied with the alternating voltage Vs from the power source Ps.

Figure 7:
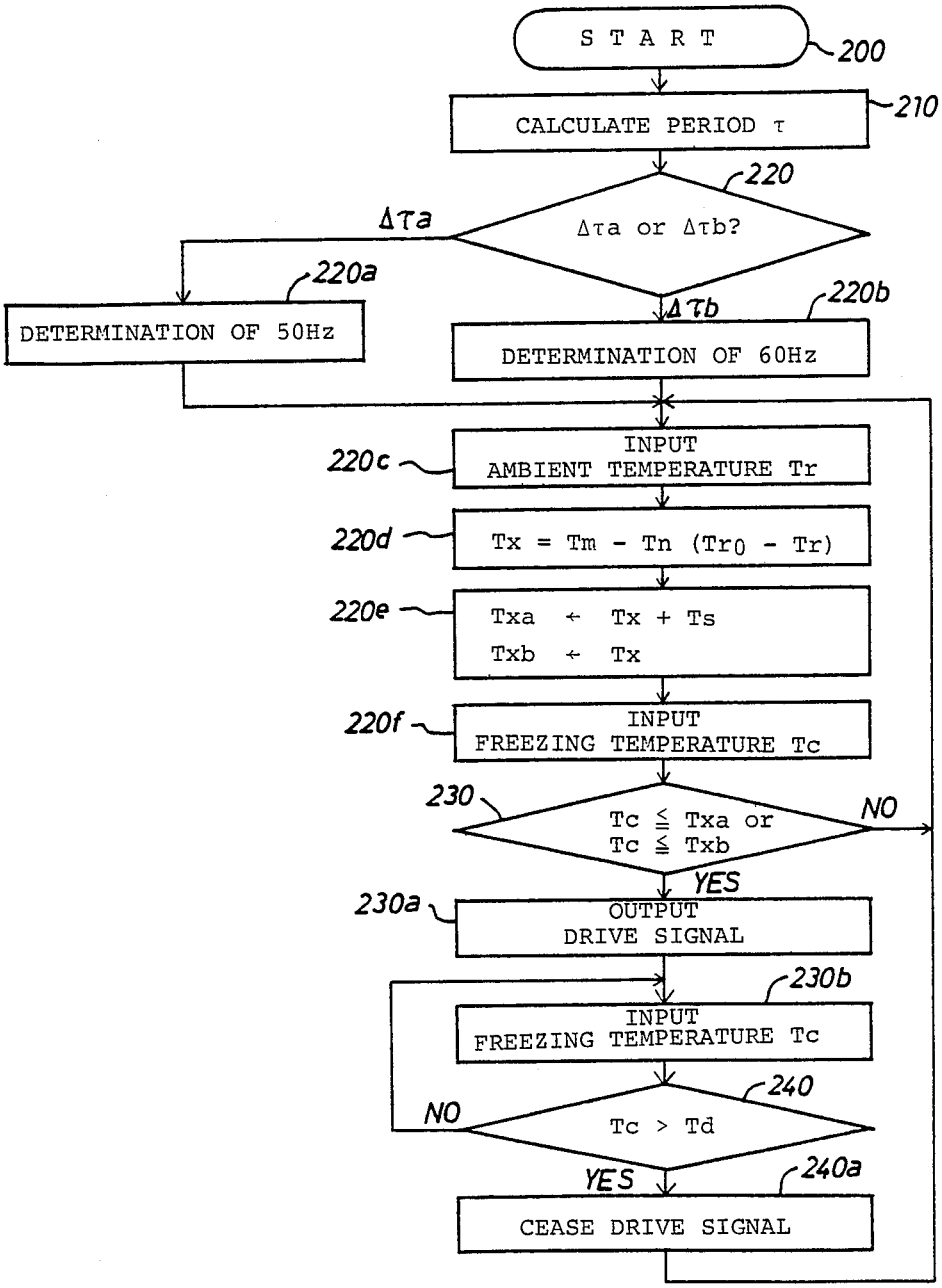
FIG. 7 is a flow chart of a control program executed by a microcomputer shown in FIG. 3.

Assuming that the water plate 30 is retained in the cell closing position during the freezing cycle of operation, the computer 120 starts to execute the control program at step 200 in the flow chart shown in FIG. 7. At the following step 210, the computer 120 calculates a period $\tau$ of a rectangular pulse applied thereto from the wave shaper 80*b*. When the period $\tau$ of the rectangular pulse is in the range $\Delta\tau a$ of from 19 ms to 21 ms, the computer 120 causes the program to proceed to step 220*a* from step 210 through step 220. Thus, the computer 120 determines at step 220*a* the fact that the frequency f of the alternating voltage Vs applied from the power source Ps is 50 Hz. When the period $\tau$ of the rectangular pulse is in the range $\Delta\tau b$ of from 15.5 ms to 17.5 ms, the computer 120 causes the program to proceed to step 220*b* from step 210 through step 220. Thus, the computer determines at step 220*b* the fact that the frequency f of the alternating voltage applied from the power source Ps is 60 Hz. In a practical embodiment, the respective ranges $\Delta\tau a$, $\Delta\tau b$ are previously memorized in a read-only memory of the computer.

When the program proceeds to step 220*c*, the computer is applied with a digital signal indicative of the ambient temperature Tr from the A-D converter 110 and causes the program to proceed to step 220*d* where the computer calculates a complete freezing temperature Tx in accordance with the ambient temperature Tr on the basis of the following formula (1).

$$Tx = Tm - Tn\,(Tro - Tr) \quad (1)$$

where the complete freezing temperature Tx is indicative of the fact that all the water in the freezing cells 21 is completely frozen into ice cubes, Tm is a temperature (for instance −15° C.) indicative of the fact that all the water in the freezing cells 21 is completely frozen at an ambient temperature Tr of 35° C. in operation of the compressor under the power supply of 60 Hz, Tn is a correction value (for instance 0.1) of Tm relative to changes of the ambient temperature Tr, and Tro is a standard value (for instance 35° C.) of the ambient temperature Tr.

After calculation of the complete freezing temperature Tx at step 220*d*, the computer causes the program to proceed to step 220*e* where the computer calculates an optimum freezing temperature Txa necessary for complete freezing of all the water in the freezing cells 21 in operation under the power supply of 50 Hz on a basis of the following formula (2) or an optimum freezing temperature Txb in operation under the power supply of 60 Hz on a basis of the following formula (3).

$$Txa = Tx + Ts \quad (2)$$

$$Txb = Tx \quad (3)$$

where Ts is a positive correction value (for instance 1° C.) for adjusting the complete freezing temperature Tx under the power supply of 60 Hz to a complete freezing temperature under the power supply of 50 Hz.

When the program proceeds to step 220*f*, the computer is applied with a digital signal indicative of the actual freezing temperature Tc of the evaporator unit 20 from the A-D converter 110. At the following step 230, the computer determines as to whether the actual freezing temperature Tc is lower than or equal to the calculated optimum temperature Txa or Txb. When the answer is "NO", the computer will repeat the execution at step 220*c* through 230. While the execution at step 220*c* through 230 is repeated curing the freezing cycle of operation, the compression in the refrigeration system is driven by activation of the motor Mcp to compress the gaseous refrigerant and feed it to the condensing coil. Simultaneously, the cooling fan is driven by activation of the motor Mf to blow air across the condensing coil in a conventional manner. The gaseous refrigerant is condensed by the condensing coil and supplied into the evaporator coil 40 in a conventional manner to freeze the water circulated into the freezing cells 21.

During the freezing cycle, the changeover switch SW is maintained in a first condition where the movable contact of switch SW is connected to the first fixed contact a. Thus, the motor mp is activated by the alternating voltage Vs applied thereto from the power source Ps through the normally closed relay switch Xa to drive the water pump P. The water picked up by the water pump P is supplied into the freezing cells 21 through the water plate 30 and is formed into ice on the walls of cells 21. The water which is not immediately frozen will fall through the return holes of water plate 30 back into the reservoir 50. The water in reservoir 50 will be recirculated into the freezing cells 21 until completely frozen into ice cubes.

When the actual freezing temperature Tc becomes lower than or equal to the calculated optimum temperature Txa or Txb, the computer determines a "YES" answer at step 230 and causes the program to proceed to step 203*a* where the computer produces a drive signal therefrom. Thus, the transistor 130*b* is turned on in response to the drive signal from the computer to energize the relay coil Rx. In response to energization of the relay coil Rx, the relay switches Xa and Xe are opened to deactivate the motors Mp and Mf. Simultaneously, the relay switch Xb is closed by energization of the relay coil Rx to apply the alternating voltage Vs to the water plate moving motor Ma therethrough from power source Ps. As a result, the water plate 30 is lowered by activation of the motor Ma to discharge the formed ice cubes from the freezing cells 21, and in turn, the movable contact of switch SW is connected to the second fixed contact b to apply the alternating voltage Vs to the water supply valve 60 from power source Ps. In this instance, the relay switch Xd is closed by energization of the relay coil Rx to open the hot gas defrost valve Vh, and the water supply valve 60 is opened to pour fresh water onto the water plate 30 through the water supply pipe 61. Thus, the formed ice cubes drop from the freezing cells 21 and fall over the surface of water plate 30 to be discharged into the ice storage bin.

Subsequently, the program proceeds to step **203*b* where the computer is applied with the digital signal indicative of the actual freezing temperature Tc. When the temperature Tc of the evaporator unit 20 becomes higher than a predetermined defrost temperature Td, the computer determines a "YES" answer at the following step 240 and causes the program to proceed to step 240*a*. At step 240*a*, the computer ceases producing the drive signal, and in turn, the transistor 130*b* is turned off to deenergize the relay coil Rx. As a result, the relay switches Xb and Xd are opened, while the relay switches Xa, Xc and Xe are closed. Thus, the hot gas defrost valve Vh is closed, and the motor Ma is activated by the alternating voltage Vs applied thereto through the relay switch Xc and changeover switch SW to raise the water plate 30 toward the cell closing position for the following freezing cycle. When the water plate 30 has been raised and retained in the cell closing position, the movable contact of switch SW is disconnected from the second fixed contact b and connected to the first fixed contact a to deenergize the water supply valve 60** and deactivate the motor Ma and to activate the motor Mp.

In the control of the ice making machine described above, the power source frequency f of 50 Hz or 60 Hz is ascertained on a basis of the period $\tau$ of the rectangular pulse in relation to the range of $\Delta\tau a$ or $\Delta\tau b$, and the complete freezing temperature Tx is determined in consideration with the ambient temperature Tr on a basis of the formula (1). Thus, the optimum freezing temperature Txa in operation under the power supply of 50 Hz is determined by correction of the complete freezing temperature Tx on a basis of the formula (2), and the optimum freezing temperature Txb in operation under the power supply of 60 Hz is determined on a basis of the formula (3). In operation of the ice making machine, the freezing cycle is maintained until the actual freezing temperature Tc of the evaporator unit 20 becomes lower than or equal to the optimum freezing temperature Txa or Txb. This is useful to insure complete freezing of all the water in the freezing cells 21 in operation under the power supply of 50 Hz or 60 Hz.

What is claimed is:

1. An ice making machine having an evaporator unit formed therein with a multiplicity of indivisual freezing cells and provided thereon with an evaporator in thermal exchange relationship with the freezing cells to freeze water circulated into the freezing cells during a freezing cycle, and means for supplying the water into the freezing cells, wherein an electric control apparatus for the ice making machine comprises;

first means for ascertaining a frequency of an electric power supplied to said ice making machine;

second means for detecting an actual freezing temperature of said evaporator unit;

third means for determining an optimum freezing temperature necessary for complete freezing of all the water in said freezing cells in operation under the power supply of the ascertained frequency; and fourth means responsive to an electric signal indicative of the actual freezing temperature from said second means for maintaining the freezing cycle until the actual freezing temperature becomes lower than or equal to the optimum freezing temperature and for terminating the freezing cycle and initiating a harvest cycle for discharge of formed ice cubes from said freezing cells when the actual freezing temperature has become lower than or equal to the optimum freezing temperature.

2. An ice making machine as claimed in claim 1, wherein said control apparatus further comprises means for detecting an ambient temperature of said ice making machine, and wherein said third means is responsive to an electric signal indicative of the ambient temperature from said detecting means to correct the optimum freezing temperature in consideration with changes of the ambient temperature of said ice making machine.

* * * * *